US006626125B1

(12) United States Patent
Klimenko

(10) Patent No.: US 6,626,125 B1
(45) Date of Patent: Sep. 30, 2003

(54) INFLATABLE WATERCRAFT AND CARGO HOLDING SYSTEMS

(75) Inventor: Konstantin Klimenko, Los Angeles, CA (US)

(73) Assignee: Sevylor U.S.A., Inc., Los Angeles, CA (US)

( * ) Notice: Subject to any disclaimer, the term of this patent is extended or adjusted under 35 U.S.C. 154(b) by 0 days.

(21) Appl. No.: 09/639,558

(22) Filed: Aug. 16, 2000

Related U.S. Application Data

(60) Provisional application No. 60/149,140, filed on Aug. 16, 1999.

(51) Int. Cl.[7] ..... B63B 7/00
(52) U.S. Cl. ..... 114/345; 114/361
(58) Field of Search ..... 114/343, 345, 114/351, 361, 364; 441/38, 40

(56) References Cited

U.S. PATENT DOCUMENTS 2,659,464 A * 11/1953 Sweetman ..... 114/353
3,595,192 A 7/1971 Vega
3,684,139 A * 8/1972 Johnson ..... 114/353
4,683,901 A * 8/1987 Mitchell ..... 114/361
5,070,807 A * 12/1991 Lewis ..... 114/361
5,546,885 A * 8/1996 Porada ..... 114/345

OTHER PUBLICATIONS

M and E Marine Catalog, 1996, Camden, NJ, p. 173.*
Achilles 89, Tokyo, Japan, Mar. 16, 1989, pp. 13, 25, 28, 29, 30.*
Avon, Dafen, Great Britain, Oct. 17, 1988, pp. 7, 12, 20.*
Bombard 1992, Stuart Florida, pp. 12, 13.*

* cited by examiner

*Primary Examiner*—Stephen Avila
(74) *Attorney, Agent, or Firm*—Dean W. Russell; Kilpatrick Stockton LLP

(57) ABSTRACT

Inflatable watercraft such as PWCs are disclosed. The watercraft function additionally as cargo holders mountable to roofs of vehicles and towable behind boats. Covers associated with the craft serve partially or completely to enclose cargo placed within the craft, protecting the cargo from wind, rain, and waves.

10 Claims, 2 Drawing Sheets

INFLATABLE WATERCRAFT AND CARGO HOLDING SYSTEMS

REFERENCE TO PROVISIONAL APPLICATION

This application is based on and hereby refers to U.S. Provisional Patent Application Ser. No. 60/149,140, filed Aug. 16, 1999, having the same title as appears above.

FIELD OF THE INVENTION

This invention relates to inflatable watercraft and more particularly (although not exclusively) to inflatable devices adapted to be towed behind boats in one configuration and to function as roof-mounted cargo holders in another configuration.

BACKGROUND OF THE INVENTION

Numerous inflatable watercraft exist. One category of such craft, sometimes called "personal watercraft" (PWC) or "towables," includes devices designed to be towed by motorboats. These devices typically support one or more persons, carrying him, her, or them through the water in which the motorboats operate.

SUMMARY OF THE INVENTION

The present invention provides inflatable watercraft which perform additional functions beyond those of conventional PWCs. When mounted to the roof of a car or truck, for example, an inflatable device consistent with the invention can function as well as a holder of cargo. Likewise, when towed behind a boat, devices of the present invention can support cargo rather than humans.

PWCs made in accordance with the invention each may include a cover made of extensible material. When affixed to a PWC, the cover serves partially or completely to enclose any cargo placed within the PWC and, to substantial extent, protect the cargo from the environment around the device. Because the cover material may be extensible, it can expand if necessary to accommodate bulky or large objects stored within the PWC. Alternatively—although not preferably—a device may be affixed to a vehicle roof with its bottom upright, effectively trapping cargo between the roof and the interior surface of the device without need for any cover.

Additionally potentially useful in connection with the invention is an elastic cord or rope, such as a bungee cord, which can attach the cover to the PWC. The elasticity of the cord permits expansion of the cover when appropriate, nonetheless conforming to the size of the cargo to maintain secure contact between the cover and PWC. This secure contact, in turn, helps protects the cargo within the inflatable device from damage due to wind, rain, or waves. Devices including aerodynamic windshields may further diminish the possibility of cargo damage and facilitate their use.

Mounting of devices of the invention to automobiles or other vehicles may occur in any suitable manner. In some embodiments of the inventive system, one or more straps may be used to attach the devices to brackets on vehicle roofs. Presently preferred systems include four such straps, tying the devices to vehicles sufficient to avoid inhibiting normal highway speed of the vehicles. If made of relatively soft, non-abrasive material such as (but not limited to) PVC, the inflatable crafts often may contact roofs of vehicles directly without damaging paint thereon.

Other components of the innovative craft may include an inflatable transom and a removable platform designed for placement on the interior bottom of the craft. Although cargo can be loaded more easily with the platform in place, its use is optional and not a mandatory part of the inventions described herein. The inflatable transom and many of the elements discussed in the preceding paragraphs likewise are optionally, rather than necessarily, included as part of the present invention.

It thus is an object of the present invention to provide increased functionality to inflatable devices such as PWCs.

It is also an object of the present invention to provide inflatable devices useful for hauling cargo, either as roof-mounted products or when towed behind boats.

If is a further object of the present invention to provide extensible covers for the inflatable devices and means both for attaching the devices to vehicle roofs and for affixing the covers to the devices.

It is an additional object of the present invention to provide cover-affixing means adapted to conform at least partially to the size of the cargo contained within a device so as to affix the cover securely to the device.

Other objects, features, and advantages of the present invention will be apparent to those skilled in the art with reference to the remaining text and drawings of this application.

DETAILED DESCRIPTION

Figure 1:
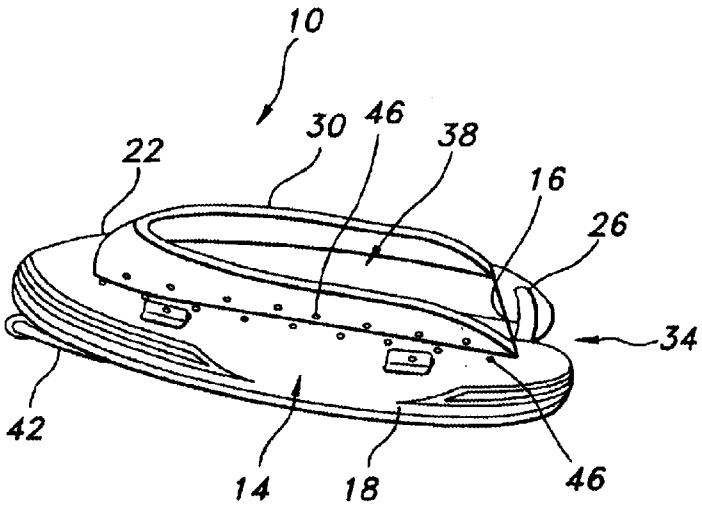
FIG. 1 is a perspective view of an exemplary PWC consistent with the present invention.

FIG. 1 illustrates an exemplary watercraft 10 which may form part of the present invention. Watercraft 10 typically includes one or more chambers 14 having valves suitable for inflation (and deflation) when desired. If inflated, chambers 14 can provide buoyancy for craft 10 in water.

As shown in FIG. 1, chambers 14 may be formed in a generally U-shaped manner. Also included in watercraft 10 is a base or bottom 16 connecting the chambers 14, positioned between and sealed (typically but not necessarily using radio-frequency welding) to portions 18 and 22 of chambers 14 analogous to the "arms" of the "U." Although chambers 14 and bottom 16 usually are made of PVC whose gauge is sufficient to support substantial weight (such as that of a human) when in water, other materials may be used instead without departing from the scope of the invention.

Also detailed in FIG. 1 are optional components of watercraft 10 including transom 26 and windshield 30. Transom 26, which may be made of inflatable material similar to chambers 14 or bottom 16, can be sealed to both at the rear 34 of watercraft 10. Unlike some transoms, transom 26 is not solely designed to allow mounting of an outboard motor. Instead, transom 26, if present, primarily functions as a boundary or barrier effectively enclosing the interior surface of bottom 16 to create a space 38 adaptable for holding both humans and cargo as desired.

Sealed, tied, or otherwise attached to chambers 14 may be a U-shaped windshield 30. It too often is formed of the same material as any or all of chambers 14, bottom 16, and transom 26 and also may be inflatable either concurrently with or separately from chambers 14. Windshield 30, as its name indicates, assists in shielding items in space 38 from wind. It additionally increases the effective height of space 38.

Yet another optional component of watercraft 10 shown in FIG. 1 is bar 42. Bar 42, illustrated as protruding from the lower front portion 46 of watercraft 10, may receive an end of a tow rope and thus serve to connect craft 10 to a motorboat or other towing vehicle. Those skilled in the art will recognize that bar 42 need not be configured as appears in FIG. 1 (and, indeed, need not necessarily be a "bar") but rather may be designed or configured differently. Finally, both chambers 14 and windshield 30 may include grommets 46, fittings, or other means through or around which one or more cords may be passed.

Figure 2:
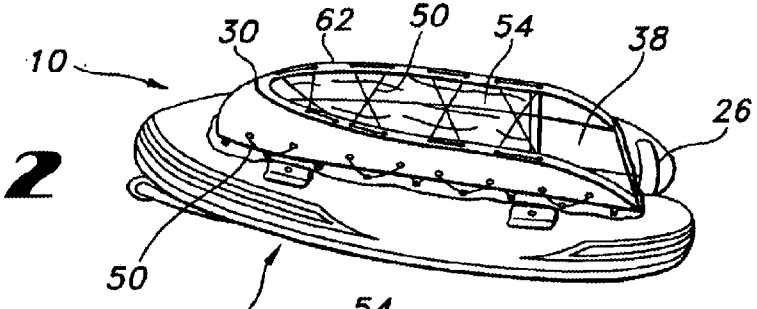
FIG. 2 is a perspective view of the PWC of FIG. 1 devoid of cargo but with a (transparent) cover affixed thereto.

FIG. 2 depicts such cords 50 threaded through grommets 46 of both chambers 14 and windshield 30. Detailed in FIG. 2 additionally is cover 54, which spans at least part of space 38 between "arms" 58 and 62 of windshield 30 and, depending on its size and configuration, may be connected to either or both of windshield 30 and chambers 14. Cover 54 may, but need not necessarily, be transparent, accounting for the manner it is illustrated in FIG. 2. It also need not extend to transom 26 and thus need not completely enclose space 38, particularly when large objects are intended to be placed in the area of space 38 adjacent the transom 26. Nevertheless, cover 54 may, if desired, so extend to transom 26 and be connected thereto so as completely to enclose space 38.

Figure 3:
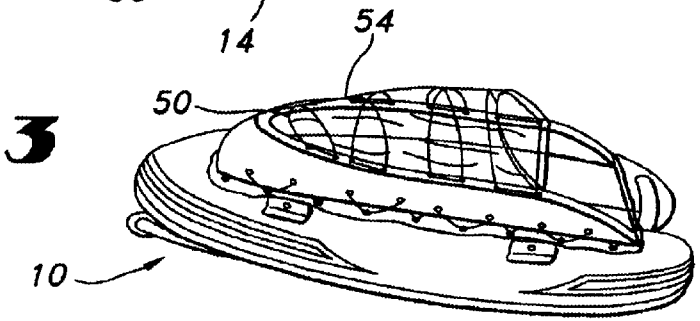
FIG. 3 is a perspective view of the PWC of FIG. 1 showing the cover of FIG. 2 in an expanded condition, as though partially enclosing bulky cargo within the PWC.
Figure 4:
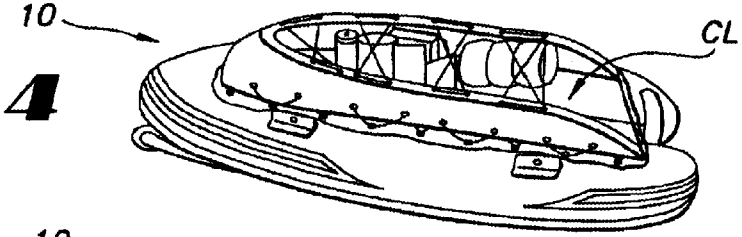
FIG. 4 is a perspective view of the PWC of FIG. 1 illustrating a typical cargo load partially enclosed by the cover of FIG. 2.
Figure 5:
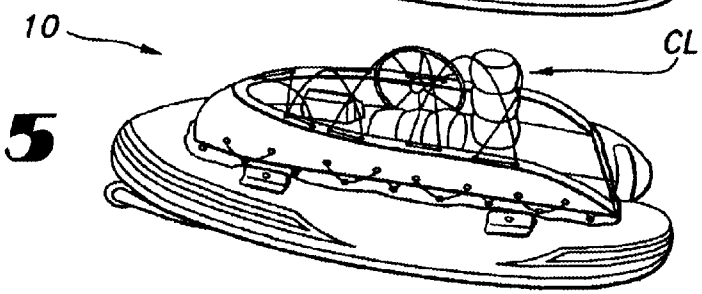
FIG. 5 is a perspective view of the PWC of FIG. 1 detailing the cover of FIG. 2 as expanded by bulky cargo contained in the PWC yet nonetheless attached securely to the PWC.

FIGS. 3–5 show various cargo-holding features of watercraft 10. Notwithstanding the absence of cargo in. FIG. 3, the drawing illustrates the fact that both cover 54 (preferably but not necessarily made of nylon) and cords 50 may have elasticity and can expand to accommodate loads protruding in space 38 above the height of windshield 30. FIG. 5 shows an exemplary, cargo load CL protruding in this manner, with cover 54 and cords 50 having extended to permit snug enclosure of load CL within space 38. Detailed in FIG. 4 is an alternate cargo load CL which does not extend within space 38 above the height of windshield 30, in which case cover 54 need not necessarily expand for purposes of accommodation. In either circumstance, however, cover 54 is taut, minimizing the possibility of wind-related damage thereto (or to the cargo load CL within space 38).

Figure 6:
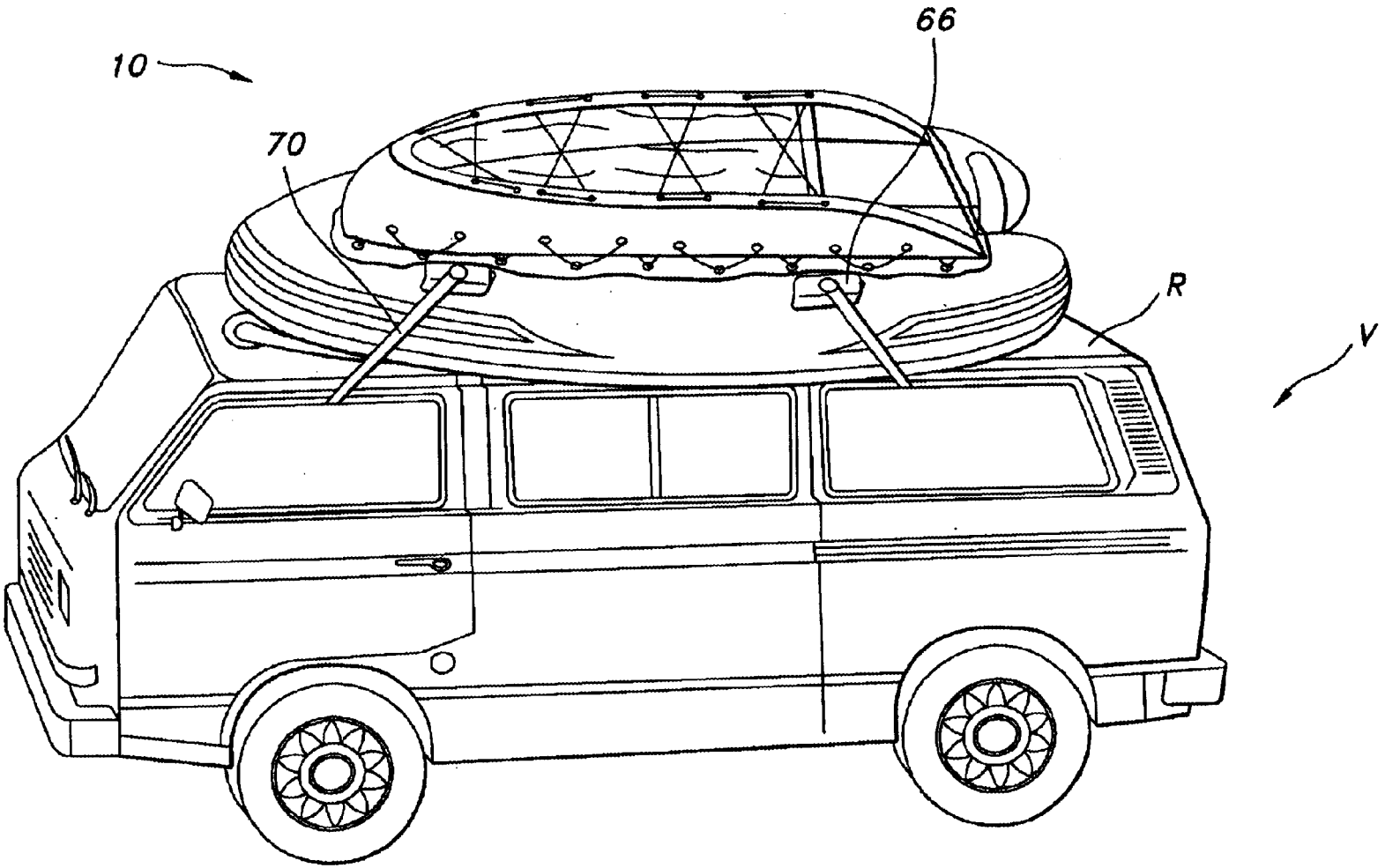
FIG. 6 is a perspective view of the PWC of FIG. 1 depicted with brackets connecting it to a vehicle for use as a land-based cargo holder.

FIG. 6 shows watercraft 10 functioning as a land-based cargo holder. In this circumstance, craft 10 will include means for attachment to the roof R of a vehicle such as van V Exemplary of such means are brackets 66, which may receive straps 70 for connection to vehicle V. Numerous other attachment mechanisms are, of course, known to those skilled in the art and may be used instead of either or both of brackets 66 and straps 70. Likewise, although the foregoing has been provided for purposes of illustrating, explaining, and describing embodiments of the present invention, further modifications and adaptations to these embodiments will be apparent to those skilled in the art and may be made without departing from the scope or spirit of the invention.

What is claimed is:

1. Inflatable craft adapted for use in first and second modes and comprising:

a. at least one inflatable component having a height;

b. a base connected to the at least one inflatable component, the base and the at least one inflatable component bounding, at least in part, a space adapted to receive at least one person when the craft is in use in the first mode and cargo when the craft is in use in the second mode;

c. a cover spanning at least part of the space when the craft is in use in the second mode, d. means for connecting the cover at least indirectly to the at least one inflatable component when the craft is in use in the second mode, at least one of the cover and connecting means being elastic so as to accommodate cargo protruding above the height of the at least one inflatable component; and e. an inflatable windshield attached to the at least one inflatable component.

2. Inflatable craft according to claim 1 further comprising an inflatable transom connected to the at least one inflatable component.

3. Inflatable craft according to claim 1 in which the cover is elastic.

4. Inflatable craft adapted for use in first and second modes and comprising:

a. at least one inflatable component;

b. a base connected to the at least one inflatable component, the base and the at least one inflatable component bounding, at least in part, a space adapted to receive at least one person when the craft is in use in the first mode and cargo when the craft is in use in the second mode;

c. a cover spanning at least part of the space when the craft is in use in the second mode;

d. means, comprising at least one expandable cord, for connecting the cover at least indirectly to the at least one inflatable component when the craft is in use in the second mode; and e. an inflatable windshield attached to the at least one inflatable component.

5. Inflatable craft according to claim 4 in which the at least one inflatable component further comprises at least one grommet through which the at least one expandable cord may be threaded when the craft is in use in the second mode.

6. Inflatable craft according to claim 4 further comprising an inflatable transom connected to the at least one inflatable component.

7. Inflatable craft adapted for use in first and second modes and comprising:

a. at least one inflatable component;

b. a base connected to the at least one inflatable component, the base and the at least one inflatable component bounding, at least in part, a space adapted to receive at least one person when the craft is in use in the first mode and cargo when the craft is in use in the second mode;

c. a cover spanning at least part of the space when the craft is in use in the second mode, d. means for connecting the cover at least indirectly to the at least one inflatable component when the craft is in the second mode;

e. means for attaching the craft, when in use in the second mode, to the roof of a vehicle so that the cargo protrudes above the base and is protected by the cover; and f. an inflatable windshield attached to the at least one inflatable component.

8. Inflatable craft according to claim 7 further comprising an inflatable transom connected to the at least one inflatable component.

9. Inflatable craft according to claim 7 in which the cover fits snugly to the cargo when the craft is in use in the second mode.

10. Inflatable craft according to claim 7 in which the cover spans all of the space when the craft is in use in the second mode.

* * * * *